United States Patent [19]

Reyes et al.

[11] Patent Number: 4,624,124

[45] Date of Patent: Nov. 25, 1986

[54] ARMATURE COIL FORMING MACHINE

[76] Inventors: Miquel A. Reyes, 555 W. 151st St., Miami, Fla. 33169; Enivaldo Alfonso, 1240 W. 37th St., Apt. 202, Hialeah, Fla. 33012

[21] Appl. No.: 682,148

[22] Filed: Dec. 17, 1984

[51] Int. Cl.[4] ..... B21D 7/02

[52] U.S. Cl. ..... 72/403; 72/384; 72/394

[58] Field of Search ..... 72/384, 381, 382, 394, 72/396, 403, 411; 29/598, 33 F, 33 L

[56] References Cited

U.S. PATENT DOCUMENTS

| | | | |
|---|---|---|---|
| 1,721,623 | 7/1929 | Hahn | 72/403 |
| 1,721,636 | 7/1929 | O'Brien | 72/394 |
| 1,721,810 | 7/1929 | Carter | 72/403 |
| 2,869,612 | 1/1959 | Bertram | 72/394 |
| 3,187,419 | 6/1965 | Johnson et al. | 29/734 |

*Primary Examiner*—Daniel C. Crane

*Attorney, Agent, or Firm*—Anthony A. O'Brien

[57] ABSTRACT

An armature coil forming machine is disclosed as including a feeding mechanism for a stock rod, a cutting mechanism and a die forming mechanism with the cutting mechanism cutting the rod in a measured length and then the die mechanism forming the rod into an armature coil; the forming operation is accomplished in three steps, i.e., an initial V-shaped form, a second step where the ends of the V-shaped form are bent parallel to each other, a final step where the apex of the V-shaped form is deformed and wherein all three steps are completed with a single stroke of the die mechanism.

4 Claims, 21 Drawing Figures

D
45A
45B
47A
49
44
22
36
40
38
34
32
270A
270B
275A
275B
275C
24
28
26
82
80
116
114
12
3
6
45
47
47B
270
271
272
273
274
275
276
277

80
112
114
116
118
120
122
126
131
133
135
137
140
141
143
145
156
166
178
180
186
190
192
194
196
198
200
202
212
214
216
218
220
222
224
242
244
250
256
258
260
270C
44
10
11

ARMATURE COIL FORMING MACHINE

BACKGROUND OF THE INVENTION

1. Field of Invention

The present invention relates to a mchine for forming coils to be used in armatures and, more particularly to an automatic armature coil forming machine.

2. Description of the Prior Art

It is known in the prior art to form armature coils by machines which require three strokes of a die to accomplish three steps of the forming; some of such machines are hand operated and some are huge pieces of machinery weighing in the area of one hundred tons. Another arrangement is disclosed in U.S. Pat. No. 3,187,419 which relates to an armature wedger machine that inserts and wedges preformed coils into an armature.

OBJECTS OF THE INVENTION

An object of the present invention is to construct an automatically operated machine for forming armature coils which is simple in operation and light in weight.

Another object of the invention is to form an armature coil in three steps by a single stroke of a coil forming machine.

It is yet another object of this invention to mount a coil forming mechanism in an inverted position to permit the formed coil to fall by gravity into an exit chute.

The present invention has another object in that the die forming mechanism and the cutting mechanism of an armature coil forming machine is disposed on the undersurface of a support table so as to be safety oriented without special guards.

It is a further object of this invention to cut a length of rod-like material fed from a supply source and simultaneously taper one end of the cut material which forms the coil and the adjacent end of fed material.

Still another object of this invention is to feed a supply of rod-like material to the cutting mechanism of a coil forming machine by one-way latching means.

Yet a further object of the present invention is to construct a one-way latching device for feeding rod-like material with a manual release to permit a two-way operation.

SUMMARY OF THE INVENTION

The present invention is summarized in a machine for forming an armature coil and the like including a supporting frame, a support plate fixed to the frame, a die head carried by the plate for reciprocating movement along a longitudinal axis, a pair of sloping edges on said die head being in spaced, parallel relationship to each other on opposite sides of the longitudinal axis, the die head having a generally V-shaped end with upper and lower portions defining a pair of end ledges, the end ledges being offset from each other and being disposed on opposite sides of the longitudinal axis, a socket carried by the plate and receiving the V-shaped end of the die head for longitudinal movement thereby, spring means normally biasing the socket toward said die head, pneumatically operated means connected to the die head for moving the same into the socket and against the bias of the spring means, a punch carried by the socket for unitary longitudinal movement therewith, the punch including a V-shaped punch blade with a pair of lower edges offset from each other and being disposed in facing relationship with the pair of end ledges, a lever for depressing the punch toward the pair of ledges on said die head and generally transverse to the longitudinal axis, a camming mechanism operating the lever after the V-shaped end of the die head longitudinally moves the socket whereby the lever depresses the punch and its lower edges toward the ledges on the die head.

DETAILED DESCRIPTION

Figures 1, 20, 21:
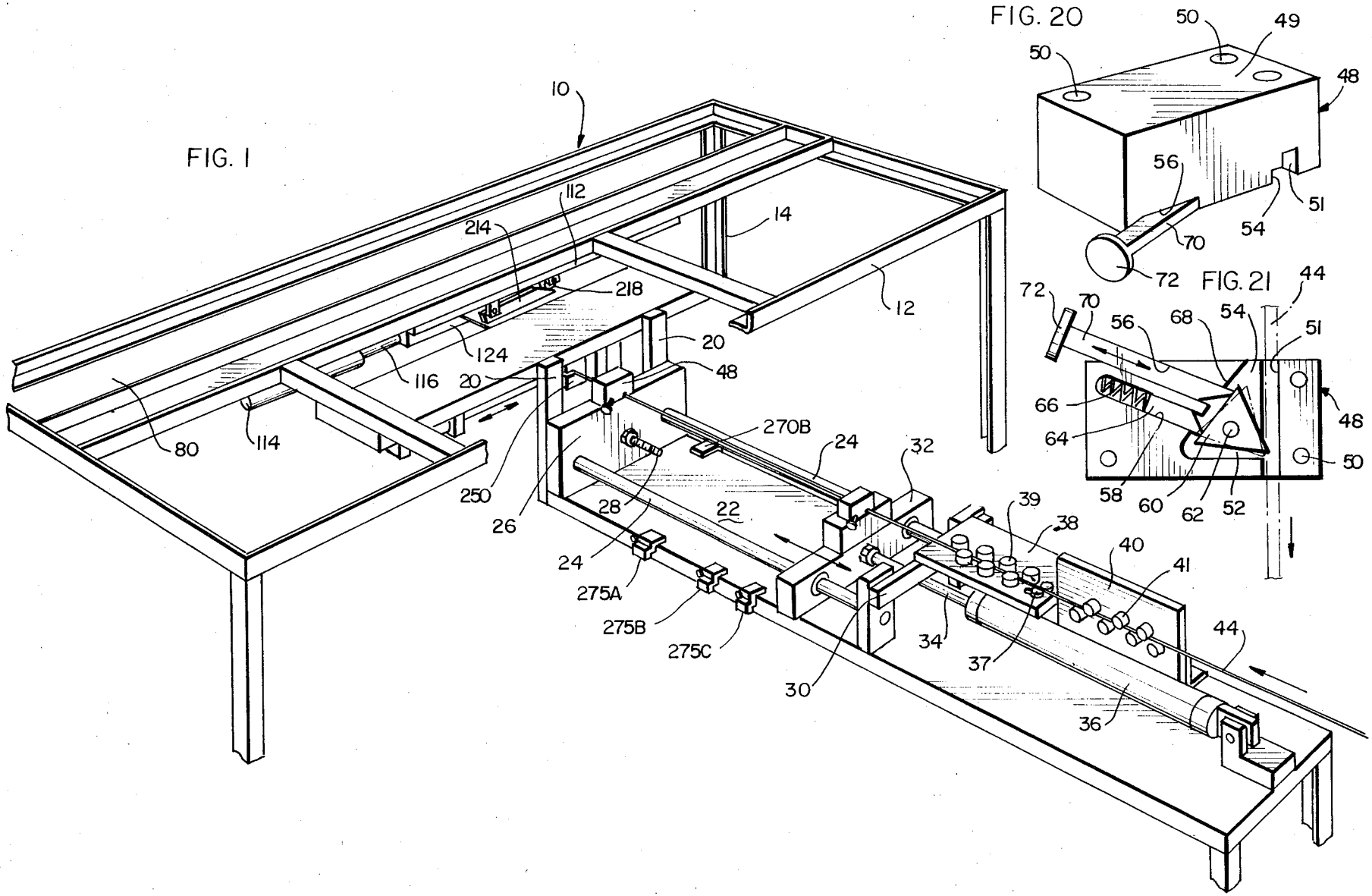
FIG. 1 is a perspective view with parts removed and parts broken away of an armature coil forming machine embodying the present invention.
FIG. 20 is a perspective view of a coil rodlock shown in FIG. 1.
FIG. 21 is a bottom plan view of FIG. 20.

The preferred embodiment of this invention as illustrated in the drawings, includes an armature coil forming machine, indicated generally at 10 in FIG. 1, having a generally rectangular skeleton-type frame 12 with four corner legs 14, and support base 16 extending from the frame 12 in generally T-shaped fashion. One end of the support base 16 is supported by legs 18 and the other end by means of support arms 20 attached to the frame 12 in generally T-shaped fashion. The base 16 includes a support table surfac 22 which carries the mechanism for moving a copper rod-like stock element to the frame 12. A pair of spaced parallel rods 24 have front ends fixedly attached to a mounting block 26 which is secured to the end of the table surface 22 and to the attachment arms 20. An adjustable stop 28 in the form of a threaded rod and a pair of lock nuts extends through a threaded bore centrally located in the mounting block 26 between the rods 24. Tne other ends of the parallel rods 24 are secured to a second mounting block 30 which in turn is fastened to an intermediate portion of the table surface 22. Intermediate the mounting blocks 26 and 30 is a movable block 32 journaled on the two rods 24 for sliding movement thereon in a forward path of travel toward the frame 12 and in a rearward path of travel back to its position as shown in FIG. 1. The movable block 32 moves toward the top 28 but does not engage such stop in normal operation; however, the stop 28 serves as a safety to limit the movement of the block 32 in the event of a malfunction.

Figures 2, 13, 14, 15, 16, 17, 18, 19:
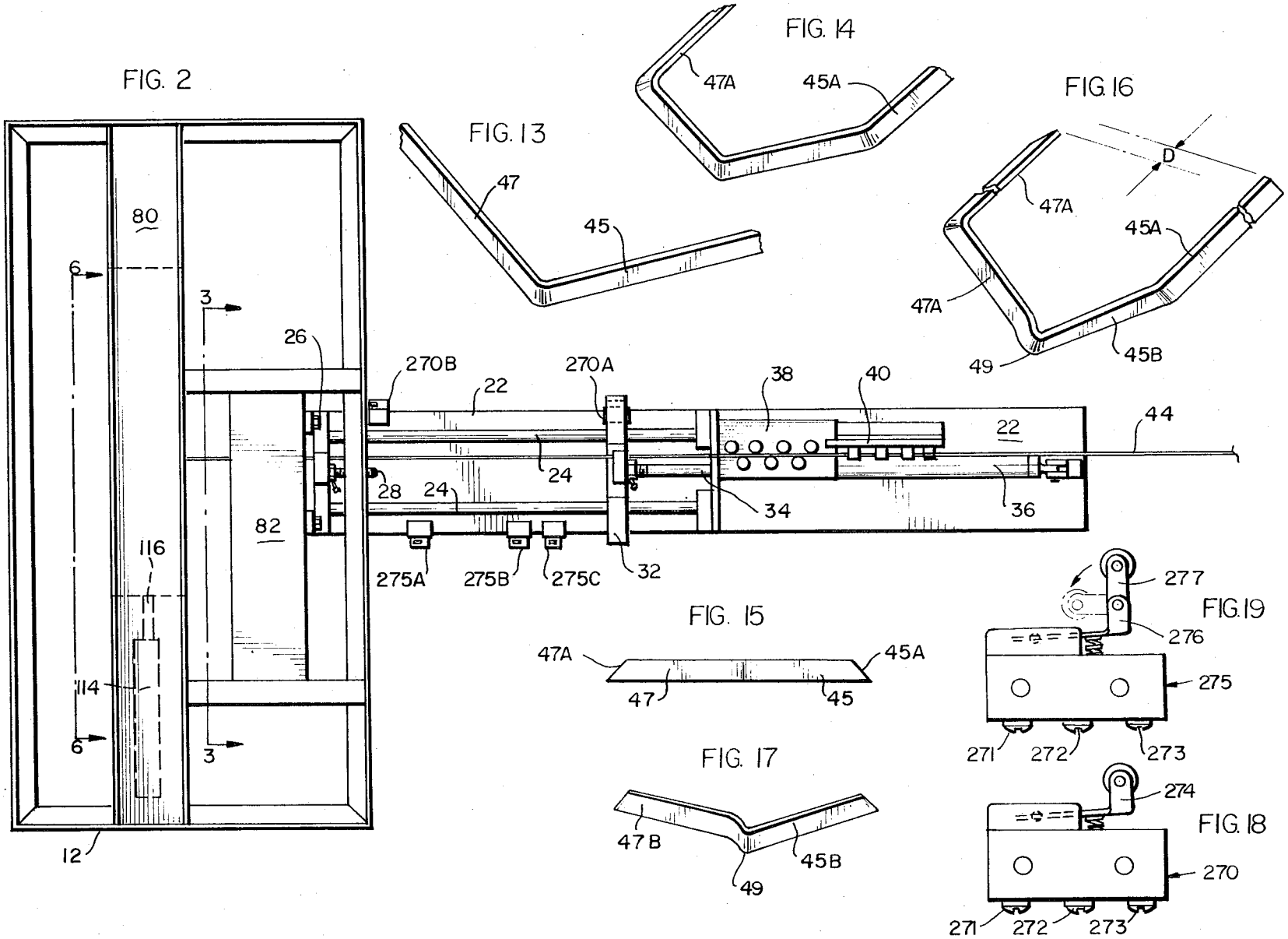
FIG. 2 is a top plan view of FIG. 1.
FIG. 13 is a partial perspective view showing the coil rod after its first forming step.
FIG. 14 is a partial perspective view showing the coil rod after its second forming step.
FIG. 15 is an end elevational view of FIG. 14.
FIG. 16 is a partial perspective view showing the coil rod in its final forming step.
FIG. 17 is a partial end perspective view of FIG. 16.
FIG. 18 is a side elevational view of an electric switch shown in FIG. 1.
FIG. 19 is a side elevational view of another electric switch shown in FIG. 1.

As shown in FIGS. 1 and 2, the central portion of the movable block 32 is fixed to the ends of a plunger shaft 34 extending out of a pneumatically operated cylinder 36, the other end of which is fixedly mounted to the table surface 22.

A horizontally disposed plate 38 and a vertically disposed plate 40 are secured together and to the mounting block 30, the three elements 30,38 and 40 may be integrally formed as a unit or secured together in any other known manner, such as by said screws. A pair of rollers 37 are mounted on vertical axes to the plate 38 adjacent the edge of plate 40; such rollers 37 are horizontally aligned in spaced relation to each other. Mounted on the plate 38 is a plurality of rollers 39 disposed to rotate about vertically axes and are offset and spaced from each other in a staggered horizontal arrangement. Mounted on the vertical plate 40 is a plurality of rollers 41 disposed to rotate about horizontal axes and being spaced from each other in a staggered vertical arrangement.

A rod 44, made of copper (preferably "bare soft" copper as known in the trade) or any other suitable armature coil material soft enough to be deformed but hard enough to retain its shape, has a generally rectangular cross-section and is fed from a supply core in edgewise arrangement into the small vertical space between vertical rollers 39. The rollers 39 and 41 define a straightening device so that the rod 44 will be precisely aligned along its longitudinal axis as it enters the forming apparatus. The pair of rollers 37, one of which is fixed and the other of which is adjustable horizontally as by being mounted in a longitudinal slot means, perform the function of assuring that the precise dimension of the rod 44 is maintained. The rod 44 in the present arrangement is generally rectangular in cross-section with outerrounded edges. The particular cross-sectional shape of the rod 44 may be altered to conform to the particular coil as required for a particular armature. After leaving the rollers 39, the rod 44 passes through a first one-way latching device 46 secured to the top of the movable block 32 and thence through a second one-way latching device 48 secured to the top of the fixed block 26. The latching devices 46 and 48 are identical so only one device will be described in detail for the sake of brevity.

As is illustrated in FIGS. 20 and 21, the latching device 48 includes a solid block 49 in the form of a rectangular parallelepiped with three through bores 50 which receive bolts (not shown) for fastening the latching device 48 to the top edge of the fixed block 26 (see FIG. 1). A channel 51 is cut out of one surface of the solid block 49 to a depth conforming to the large dimension of the rectangular rod 44; the width of the channel 51 is approximately twice the small dimension of the rectangular rod 44. A second cut-out in the same one surface of the block 49 defines a recessed surface 52 having a depth approximately one-half the depth of the channel 51. The recessed surface 52 includes three areas, a generally triangular area 54, and two spaced rectangular slots 56 and 58.

The triangular area 54 has one side which opens into the channel 51 thereby establishing communication therebetween; as shown in FIG. 20, one end of the triangular area 54 opens to an outside wall of the solid block 49 and the channel 51 thereof to provide a stepped opening which facilitates the insertion of the rod 44 into the channel 51. The rectangular slot 56 has one end intersecting one side of the triangular area 54 to communicate therewith and an opposite end opening to the same outside wall of the solid block 49 as does the area 54 but being spaced therefrom. The other rectangular slot 58 is in spaced parallel relation to the slot 56 and defines a closed end intersecting one side of the triangular area 54 to communicate therewith and an opposite end closed as by being spaced from the other walls of the solid block 49.

A triangularly shaped locking piece 60 is rotatably mounted in the triangular area 54 by means of a fixed pivot pin 62; the locking piece 60 has one point which protrudes into the channel 51 so as to engage the large dimension of the rectangular rod 44. Adjacent its second point, the locking piece 60 is engaged by the nose end of a generally rectangular slider element 64 which protrudes out of the rectangular slot 58. A coil spring 66 is mounted in compression between the end wal df slot 58 and the inner end of the slider 63 which biases the locking piece 60 in a counter clockwise direction about the pivot pin 62 as viewed in FIG. 21 whereby the first point on the locking piece 60 is biased into engagement with the large dimensional side of the rod 44. Adjacent its third point and on its same triangular side as engaged by the end of slider 64, the locking piece 60 is engaged by the curled extension 68 of a generally rectangular actuator 70 which is disposed in the rectangular slot 58. The curled extension 68 protrudes into the triangular area 58 with one side engaging the locking piece 60 and its opposite side engaging the one wall forming the triangular area 54. Inasmuch as the locking piece 60 is biased counter closkwise as viewed in FIG. 21, the locking piece is biased into engagement with the one wall forming the triangular area 54. A manually operated push button 72 is located on the outer end of the actuator 70 for releasing the locking piece 68 from the coffer rod 44.

With respect to FIGS. 1 and 2, the copper rod is initially fed forwardly through the latching devices 46 and 48 from the right to the left. During such feeding, the locking piece 60 of each latching device is rotated clockwise (as viewed in FIG. 21) against the bias of the coil spring 66. Movement of the copper rod 44 backwards through the latching devices 46 and 48 is precluded by their locking pieces 60 which will not rotate counter clockwise except for the small amount as shown from the dashed lined position to the solid line position in FIG. 21. Thus, each latching device 46 and 48 is a one-way mechanism which permits rod movement only in the forward direction. If necessary to free the rod 44 from such one-way movement to a two-way movement, such as to correct a machine malfunction, inter alia, the push button 72 is depressed causing clockwise rotation of the locking piece 60 so that the first point thereof is released from the copper rod 44 whereby relative movement between the rod 44 and the locking piece 60 is permitted.

During operation of the machine, the pneumatically operated plunger 34 is extended and moves the block 32 from the initial position shown in FIG. 1 to a forward position adjacent but not touching the stop 28. Latching device 46 moves the same distance with the block 32 and the locked condition of the locking piece 60 causes the rod 44 to move therewith. Thus, the rod 44 is forced to move through the latching device 48 the same amount of distance as the block 32 travels. During subsequent return movement of the block 32, the rod 44 is prevented from rearward movement by the latching device 48 which is fixed on the block 26 but the latching device 46 does slide along the non-moving rod 44 to return with the block 32 to the initial position.

Figure 3:
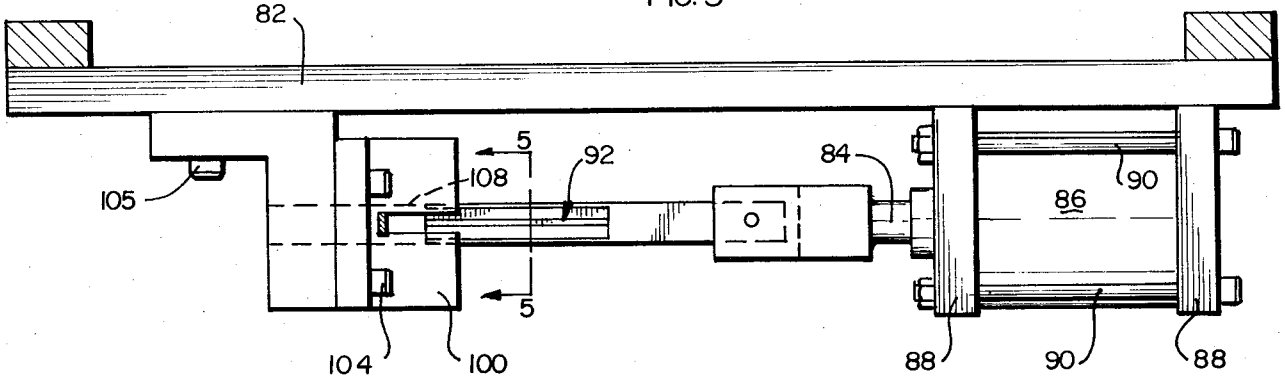
FIG. 3 is a cross sectional view taken along line 3—3 of FIG. 2 showing the coil rod cutter mechanism.
Figure 5:
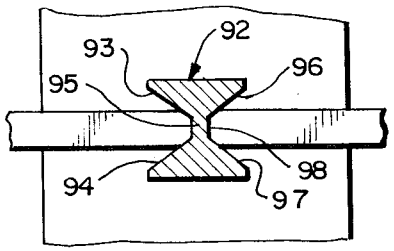
FIG. 5 is a partial cross sectional view taken along line 5—5 of FIG. 3.
Figure 4:
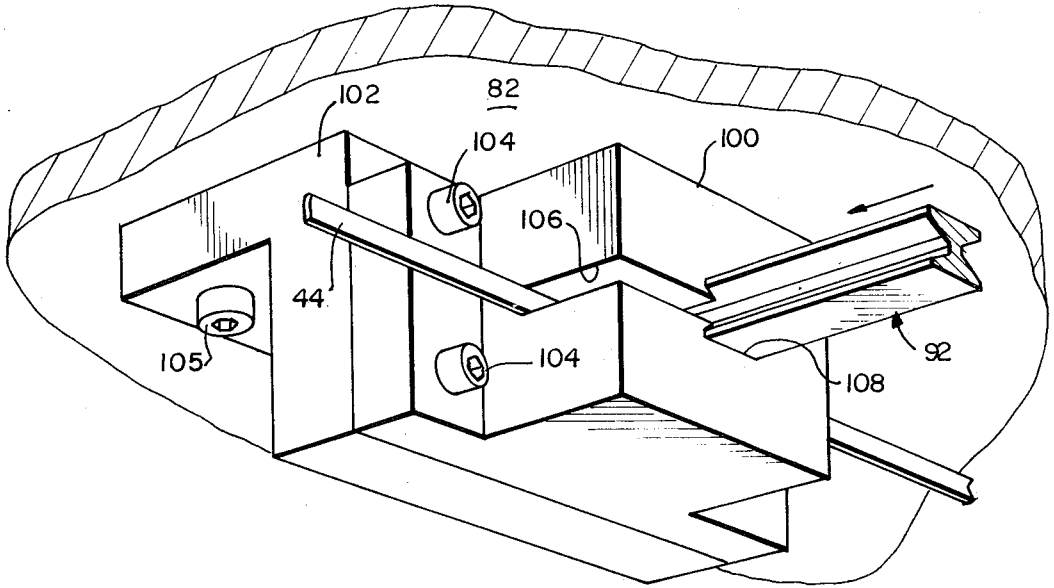
FIG. 4 is a partial perspective view looking from underneath FIG. 3.

The foreward and return strokes of the plunger 34 continues automatically so that with each forward stroke, a predetermined length of rod 44 is positioned for the subsequent operations of cutting and forming the rod 44 into an armature coil which operations are performed underneath the rectangular frame 12 As shown in FIGS. 1 and 2, the frame 12 includes a pair of spaced longitudinally extending table-like support members 80 and 82. As illustrated in FIG. 3, the cutting mechanism includes a plunger element 84 and its pneumatically operated cylinder 86 is attached to the undersurface of support member 82 by any suitable fastening means, such as a pair of spaced brackets 88 with a plurality (4) of threaded nut and bolt assemblies 90. The outer end of the plunger 84 is secured to one end of a cutter 92 which reciprocates relative to a work holder in response to movement by the pneumatically operated cylinder 86. Upper and lower tapering sides 93 and 94 of the cutter 92 are joined by a central side 95; as viewed in FIG. 5 similarly tapering sides 96 and 97 and central side 98 are located on the right of cutter 92. As is illustrated in FIG. 4, the cutter 92 reciprocates in a cutter holder 100 which is secured to an inverted L-shaped bracket 102 by a plurality of cap screws 104; the bracket 102 is in turn secured to the undersurface of support member 82 by a plurality of cap screws 105. Adjustable slots are provided for the cap screws 105 whereby length of the rod 44 to be cut may be adjustably preset. The cutter holder 100 has a slot 106 centrally disposed therein to a depth of approximately two-thirds of its width. The thickness of the slot 106 conforms to the large dimension of the rectangular rod 44 and in an edgewise fashion. In the holder 100, the slot 106 is perpendicular to a through opening 108 (FIG. 3) which has a cross-sectional configuration conforming to the cross-sectional shape of the cutter 92. As shown in dashed lines in FIG. 3, the through opening 108 registers with a through hole 110 in the L-shaped bracket 102 whereby scrap pieces cut off from the copper rod 44 bythe cutter 92 are displaced from the machine.

Figures 6, 7, 8:
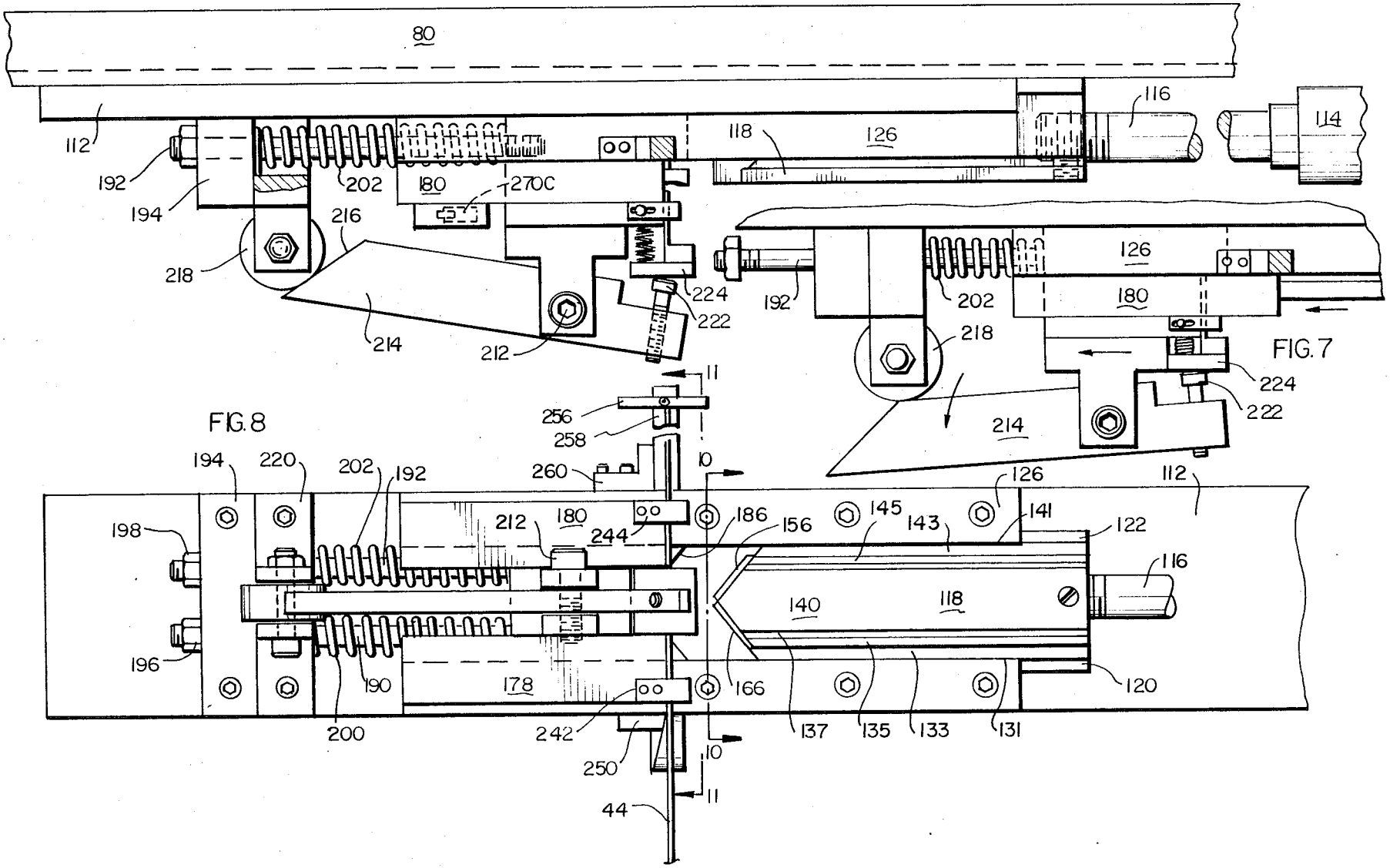
FIG. 6 is a partial cross sectional view taken along line 6—6 of FIG. 2.
FIG. 7 is a side elevational view of details of FIG. 5 shown in a different operating position.
FIG. 8 is a bottom plan view of FIG. 6.
Figure 9:
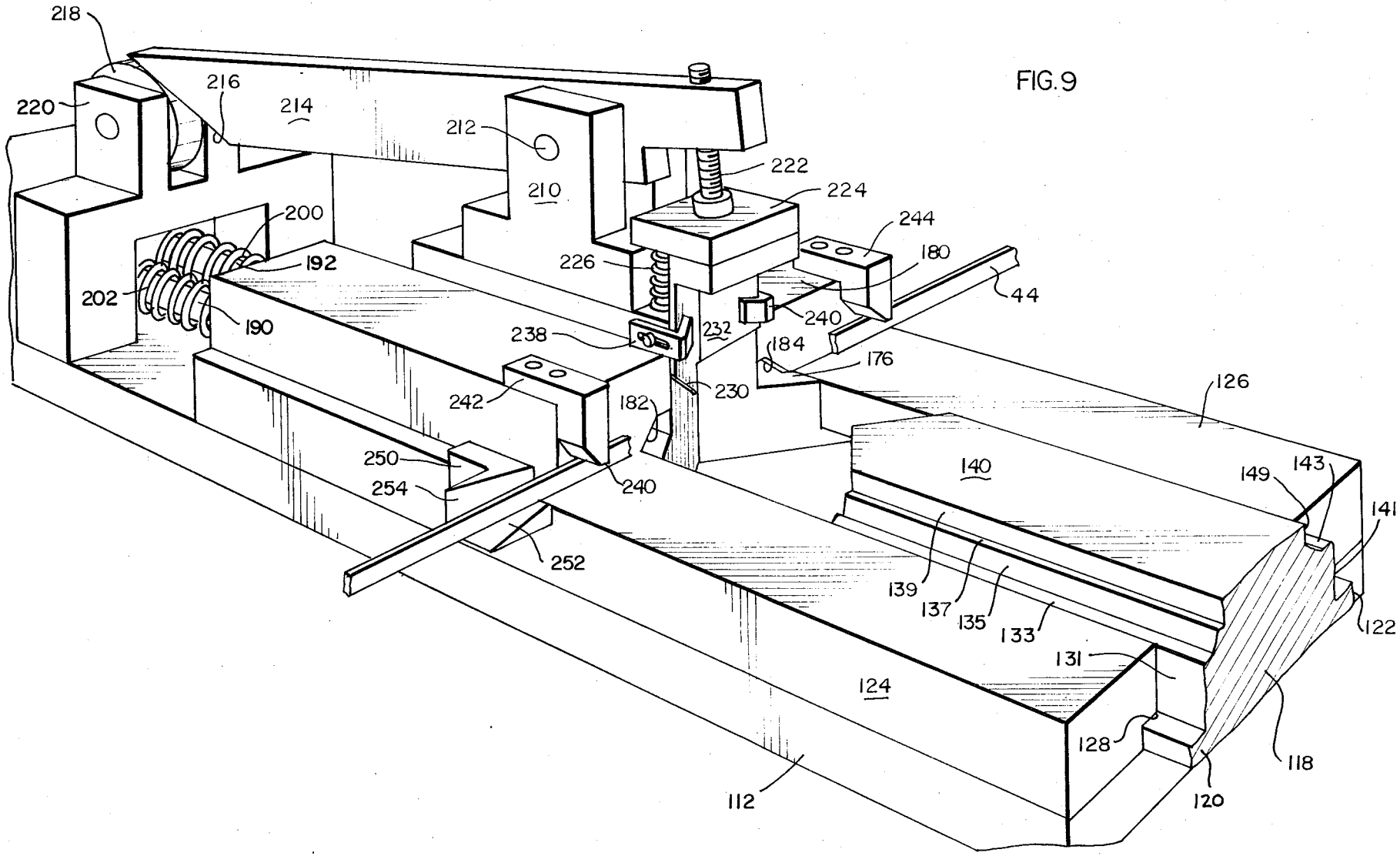
FIG. 9 is a perspective view on a larger scale looking from underneath of FIG. 6.
Figure 10:
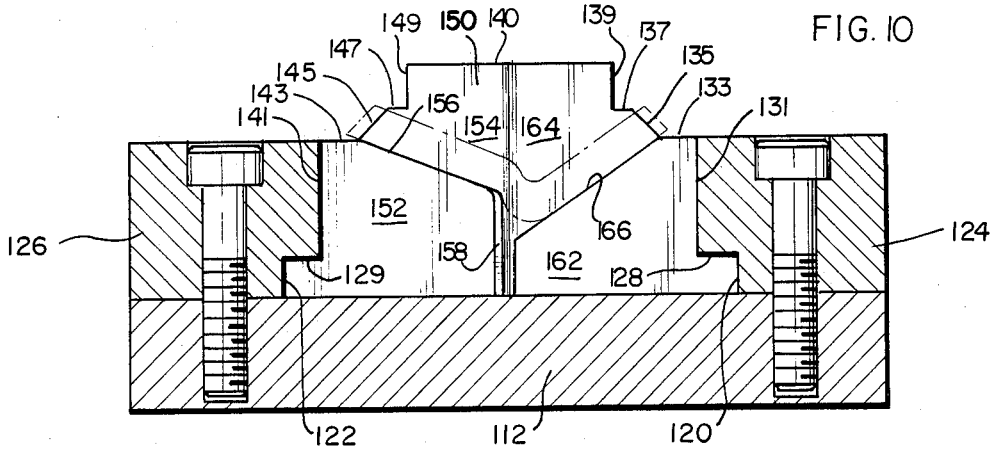
FIG. 10 is a cross sectional view taken along line 10—10 of FIG. 8.

The coil forming mechanism shown in FIGS. 6–8, and in inverted form in FIG. 9, includes an attachment plate 112 secured as by a plurality of bolts to the undersurface of support member 80 (FIG. 1). A pneumatically operated cylinder 114 is attached to the plate 112 and the member 80 and carries an operating plunger 116 which has its end portion fixedly attached to the outer end of a die head 118 to effect longitudinal reciprocating movement of such die head 118. The bottom surface of die head 118 (FIG. 9) is provided with a pair of edge flanges 120 and 122 which are slidably disposed in and supported by a pair of generally rectangular bars 124 and 126. As viewed in FIG. 9, the lower facing edges of the bars 124 and 126 have square cut-outs 128 and 129 respectively receiving the edge flanges 120 and 122 (also see FIG. 10) for slidable movement therein; the cut-outs 128 and 129 extend for the entire length of the respective bars 124 and 126 and retain the die head flanges therein as well as a slide block 169 to be described hereinafter.

The left side of the die head 118 as viewed in FIG. 9 is provided with a series of inwardly and upwardly directed, longitudinally extending steps defined by vertical surface 131 extending from the flange 120 to a plane common to the exposed surface of the bar 124, by a horizontal surface 133 extending in such plane away from the bar 124, by a sloping surface 135 extending at an angle of approximately 135° to a second horizontal surface 137 which extends to a second vertical surface 139 that joins the top surface 140 of the die head 118. The right side of die head 118 is a mirror image of the left side and is provided with an identical series of steps including surfaces 141, 143, 145, 147 and 149 which joins top surface 140.

The leading end 150 of the die head 118 has a generally V-shaped configuration. As viewed in FIG. 10, the left side of such leading end 150 includes a lower portion 152, an upper portion 154 and a sloping step portion 156 therebetween. The step portion 156 has a surface dimension approximately the same as the small dimension of the rectangular rod 44 and extends from the line where the horizontal side surface 143 meets the sloping surface 145 to a line where it intersects a vertical surface 158 on the inner part of the lower portion 152. The vertical surface 158 is the same width dimension as the sloping portion 156 and is spaced a distance of the same dimension from the apex of the V-shaped end 150. The right side of the leading end 150 includes a lower portion 162, and upper portion 164 and a sloping step portion 166 therebetween. The step portion 166 has a surface dimension approximately the same as the small dimension of the rectangular rod 44 and extends from the line where the horizontal side surface 133 meets the sloping surface 135 to a line where it intersects a vertical surface 168 on the inner part of the lower portion 162. The vertical surface 168 is the same width dimension as the sloping portion 166 and terminates at the apex of the V-shaped end 150. The vertical dimension of the apex of end 150 is approximately 4 centimeters, of the surface 158 is approximately 2 centimeters and of the surface 168 is approximately 1 centimeter.

Figure 11:
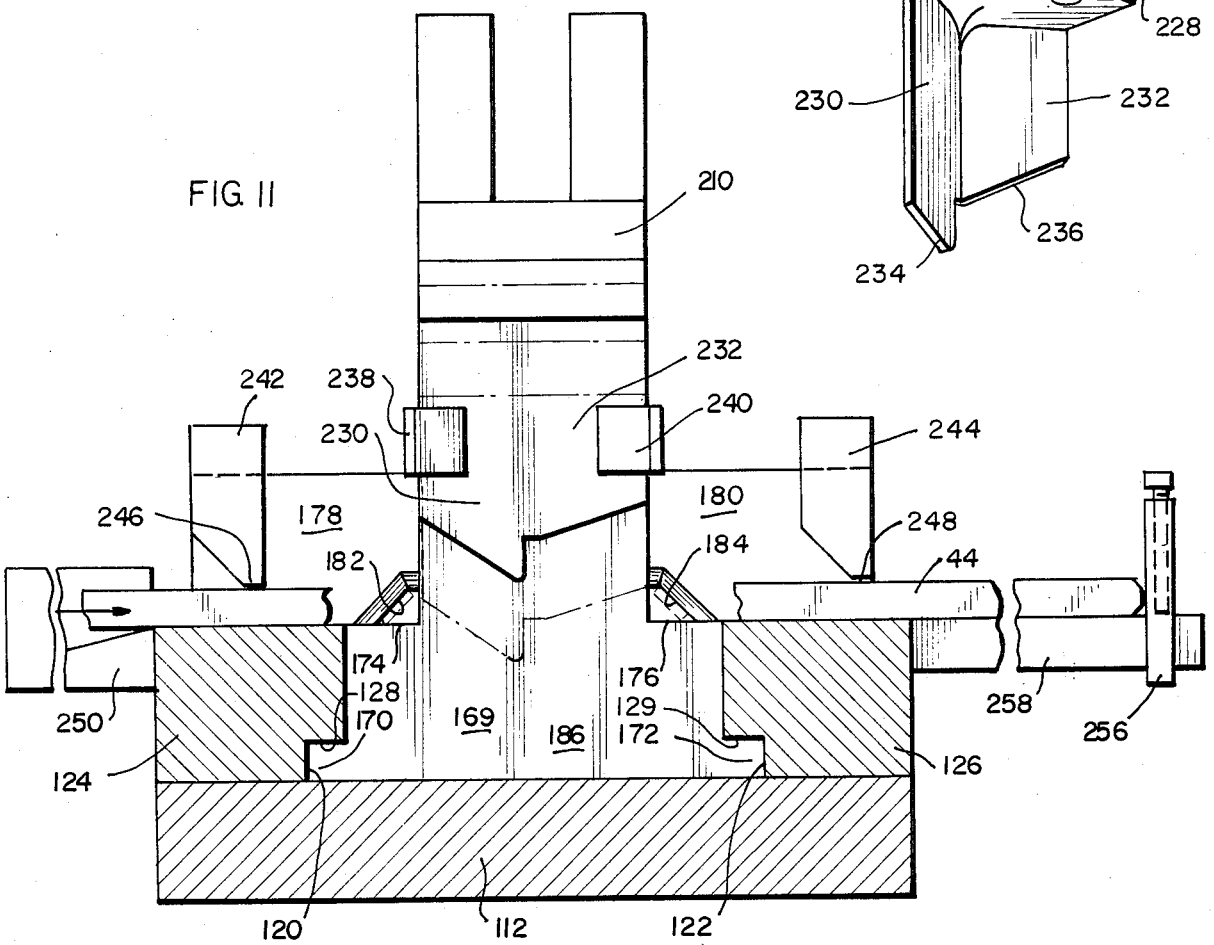
FIG. 11 is a cross section view taken along line 11—11 of FIG. 8.

The shaped end 150 of the die head 118 on its forward stroke moves into a socket mechanism best shown in FIGS. 9 and 11 as including a slide block 169 having a bottom surface the same width as the die head 118 and being in sliding surface contact with the same surface of the attachment plate 112 as is the die head surface; the bottom surface of the slide block 169 is provided with a pair of edge flanges 170 and 172 which are slidably disposed in the cut-outs 128 and 129 of the respective support bars 124 and 126. An intermediate portion of the slide block 169 has a second pair of edge flanges 174 and 176, on which are mounted retaining bars 178 and 180, respectively, as by a plurality of bolts which extend through the respective support bars 124 and 126 and into the attachment plate 112. As viewed in FIGS. 9 and 11, the lower facing edges of the retaining bars 178 and 180 have respective cut-outs 182 and 184 extending throughout their lengths. Each of the cut-outs 182 and 184 have a generally triangular configuration. A generally V-shaped socket end 186 on the slide block 169 is disposed in facing relationship to the die head end 150 whereby the die head end portions 152 and 162 may mate with the socket end 186.

The left end of the slide block 169 as viewed in FIGS. 8 and 9 carried a pair of spaced rods 190 and 192 which extend through a bearing block 194 and have adjustable stop nuts 196 and 198 on their respective free ends. A coil spring 200 surrounds the rod 190 and is mounted in compression between the slide block 169 and the bearing block 194, a coil spring 202 is similarly disposed on the rod 192. The bearing block 194 is fixedly attached to the plate 112 as by a plurality of bolts. The nuts 196 and 198 define the return limit of travel of the slide block 169 and may be reset to adjust the distance between the die head end 150 and the socket end 186.

Mounted on top of the socket slide block 169 is a punching mechanism (FIG. 9) which includes a generally U-shaped frame 210 with its base fixed to the slide block 169 as by a plurality of bolts and with its vertically extending legs carrying a privot pin 212. A lever 214 is pivotally mounted intermediate its ends on the pivot pin 212. One end of the lever 214 sloped to define a camming surface 216 which engages roller 218 that is privotally mounted in a V-shaped support 220 fixed to the plate 112 adjacent the bearing block 194. The other end of the lever 214 carries a punch head 222 which is adjustable vertically in the lever 214.

Figure 12:
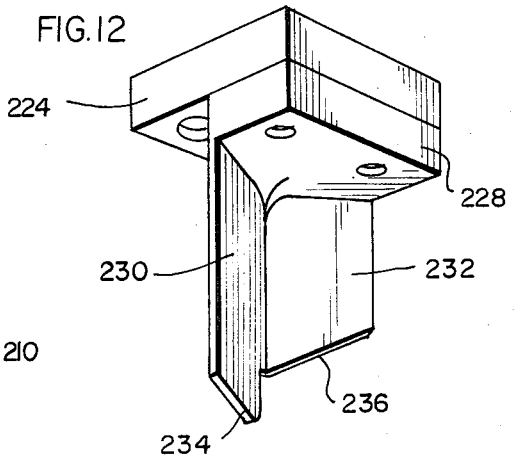
FIG. 12 is a perspective view of the forming block shown in FIG. 11.

A punch plate 224 is biased into engagement with the punch head 222 by a pair of coil springs 226 (only one shown in FIG. 9) mounted in compression between the slide block 169 and the punch plate 224. A punching blade (FIG. 12) has a base element 228 secured to the punch plate 224 as by bolts and a pair of blades 239 and 232 defining a generally V-shaped configuration conforming to the socket end 186. The blade 230 has a punch end 234 which is sloped to conform to the sloping surface 156 on the die head 118 while the blade 230 has a punch end 236 which is sloped to conform to the sloping surface 166 on the die head. A pair of clamps 238 and 240 are adjustably mounted on the slide block 169 to guide the vertical movement of the punch blades 230 and 232. The base element 228 abuts the tops of the clamps 238 and 240 (FIG. 9) to limit the punching movement of the punching mechanism.

The rod 44 is disposed under the punch ends 234 and 236 and is retained therein for a punching operation by a pair of L-shaped retaining guides 242 and 244. The rod 44 is disposed in edgewise fashion with one edge being disposed adjacent flat surfaces 246 and 248 on the respective guides 242 and 244; the oppsoite edge of the rod 44 is disposed adjacent the top surfaces (as viewed in FIG. 9) of the rectangular bars 124 and 126, respectively.

In order to facilitate the initial feeding of the rod 44 into the forming mechanism, a guide 250 is mounted on the side of the rectangular block 124. The guide (FIG. 9) has a horizontally sloping surface 252 and a vertically sloping surface 254 adjacent each other to function as a funnel to direct the movement of the entering end of the rod 44 during its intial feeding. The rod 44 projects out of the forming mechanism to a length determined by stop plate 256 adjustably mounted lengthwise on a square bar 258 which is fixed to the side of the rectangular block 126 by means of an L-shaped bracekt 260. The particular cutting and forming steps of the rod 44 as illustrated in FIGS. 13–17 will be described below in conjunction with a description of sequence of operation.

The pneumatically operated piston and cylinder devices 36, 86 and 116 may take any suitable form of construction. In the present installation, it was found suitable to use such a device made by Lynair, Inc. and bearing Ser. No. 104,023 and Model Number LH-G302.

The operation of the armature coiling forming machine is automatically controlled by electrical switches as are illustrated in FIGS. 18 and 19. The control system uses three electrical switches 270 shown in FIG. 18 as including a roller actuated pivoted lever operator; while any suitable type of switch may be utilized, in the present installation, it was found suitable to use a switch made by MICRO SWITCH and bearing number BZ-2RW22-A2. The control system also uses three electrical switches 275 shown in FIG. 19 as including roller actuated double pivoted lever operator; other suitable switches may be utilized but in the present installation, it was found suitable to use a switch made by MICRO SWITCH and bearing number BX-2RW826-A2. Switch 270 is a conventional snap switch having a common terminal 271, a normally open terminal 272 and a normally closed terminal 273; the roller is fixed to a biased lever operator 274 and is adapted to close a circuit when the roller is moved downward as by the right edge of the movable block 32 (FIG. 1). Switch 275 is substantially the same and switch 270 with 3 identical terminals 271, 272 and 273; the roller is fixed to a double pivoted lever operator including a biased lever operator 276 (similar to switch 270) having a pivot pin parrying a one-way pivoted lever 277 on which the roller is mounted. During a forward motion, the movable block 32 will merely rotate the roller and lever 277 through an arc of 90° as shown in dashed lines in FIG. 19, but during a return motion will actuate switch 275 by engaging the roller and lever 277 in its upright position; a return coil spring on the pivot pin for the lever 277 assures return of the roller and lever 277 to its upright position after the movable block 32 passes the switch 275 on its forward motion. The switches 270 and 275 are adjustably mounted on the support base 16 by means of L-shaped brackets.

SEQUENCE OF OPERATION

The rod 44 is manually fed from the supply roll through the rod straightener devices 41 and 39, the one-way latching devices 46 and 48, and the slot 106; the mannual feeding is halted at this point and the cutting mechanism is actuated by a manual operation of the pneumatic cylinder 86 extending its plunger 84 whereby the cutter 92 severs a small end portion of the rod 44 and leaves a rod end with a tapered shape as shown in FIG. 16. The machine is now in condition for its automatic operation which is commenced by an on-off switch (not shown) to supply electricity from a suitable source to the various switches in the control system which also include solinoid actuated double acting air valve (not shown) made by Numatics and bearing model number 227-833B.

It is noted that many suitable electric and pneumatic control systems may be utilized for the present machine. Accordingly, a specific wiring diagram may take many forms, for the purpose of the present invention, it is only necessary that the location the location of the switches be identified so as to perform a particular control function. Thus, the movable block 32 closes switch 270-A to actuate the pneumatic cylinder 36 and commence forward motion of the movable block 32 whereby the rod 44 moves with latching device 46 and is pushed through the latching device 48 so that the forward tapered end of the rod 44 abuts the stop plate 256 in FIG. 11. At the same time, the movable block 32 actuates the switch 270-B so that the other side of the double acting piston in the pneumatic cylinder 36 commences the return stroke of the piston shaft 34. During such return stroke, the movable block first closes switch 275-A whereby the cutter 92 is actuated to sever the rod 44 (FIG. 5) leaving tapered ends on each side of rod 44 so that the severed rod 44 thus has two tapered ends. Continued return movement of the movable block 32 closes the switch 275-B so that the cutter 92 is returned to its rest postion by its associated piston and cylinder 86. Subsequently, the movable block 32 closes the switch 275-C so that the piston and cylinder 114 is actuated causing forward movement of the die head 118. The leading end 150 of the die head 118 moves into engagement with the severed rod 44 which is bent against the socket end 186 to form the severed rod into two right angled legs 45 and 47 as shown in FIG. 13. Continued movement of the die head 118 causes rearward movement of the slide block 169 toward each other whereby the rod legs 45 and 47 are forced into the slide block cut-outs 182 and 184 and into contact with the die head sloping surfaces 135 and 145, respectively; thus the legs 45 and 47 have twisted and bent portions 45-A and 47-A as shown in FIG. 14. As is apparent from FIG. 14, the leg portions 45-A and 47-A are parallel and are twisted outwardly from each other so as to conform to spaced cylindrical surfaces on an armature rotor against which they will be resting. The continued movement of the die head 118 and the socket slide block 169 assures that the leg portions 45-A and 47-A will be formed parallel to each other; during this time, the lever camming surface 216 is moved against the roller 218 causing pivoting of the lever 214 whereby the punch head 222 depresses the punching plate and blades 230 and 232 (see FIG. 7). The adjacent edges of the legs 45 and 47 are engaged by the blade ends 236 and 234, respectfully, and forced against the die head step portions 156 and 166; because of the different heights between the step portions 156 and 166 the leg portion 45-B is displaced at the leg nose portion 49 which is curled to meet the leg portion 47-B. This arrangement permits the nose portion 49 to be inserted over the leg portion 45-B of an adjacent coil assembled on the armature rotor.

As the slide block 169 reaches the end of its forward stroke, it closes switch 270-C (FIGS. 6 and 7) causing the pneumatic cylinder 114 to return the forming die head 118 to its initial position. Simultaneously, the movable block 38 will be returned to its initial position and again closes the switch 270-A to commence another cyle. When the die head 118 is retracted out of the socket mechanism, the finished coil drops by gravity into a storage bin.

By mounting the cutting and forming mechanism underneath the supports 80 and 82, the cut-off pieces and waste pieces of the copper rod 44 will drop by gravity to a salvage bin. In addition, none of the cutting or forming mechanism is exposed on the top surface of the machine; thus hands and arms of an operator are safely displaced from such mechanisms.

As is apparent in FIG. 16, the finished coil has a leg 45-A which is longer in length than the leg 47-A by a small dimension D shown in FIG. 16. This permits the coil to be easily inserted in the armature rotor by the inserted long leg first rather than attempting to fit both legs simultaneously.

Inasmuch as the present invention is subject to many variations, modifications and changes in details, it is intended that all matter contained in the foregoing description or in the accompanying drawings, shall be interpreted as illustrative and not in a limiting sense.

We claim:

1. A machine for forming an armature coil and the like comprising:

a supporting frame (12), attachment plate means (112) fixed to said frame (12)

a die head (118) of generally rectangular configuration slidably carried by said plate means (112) for reciprocating movement along a horizontal longitudinal axis, said die head (118) having a pair of side walls, a leading end (150) of generally V-shaped configuration and an opposite end, pneumatically operated means (114) including an operating plunger (116) connected to the opposite end of said die head (118) for movement thereof;

an edge (135, 145) on each side wall of said die head (118) sloping away from its side wall throughout its entire length from the leading end (150) to the opposite end, said leading end (150) including a central vertical axis dividing upper (152, 162) and lower (162, 164) portions on each side of the central vertical axis, a ledge (166) sloping from the edge (135) on its side wall to the cental axis and a ledge (156) sloping from the edge (145) on its side wall to the central axis, said ledges (166, 156) being offset from each other and are joined to each other at the central vertical axis, socket means carried by said plate means and including a slide block (169), a retaining bar on each side of said block having a cut-out portion (182, 184) whereby portions of the sloping edges (135, 145) slide into the cut-out portions (182, 184), spring means (200, 202) operatively disposed to normally bias said slide block (169) toward the V-shaped end (150) of said die head (118)

punch means (230, 232) mounted on said socket means for reciprocating movement therewith, lever means (214) pivotally mounted on said slide block (169) and having a pair of opposite ends with one end engaging said punch means for moving the same vertically toward said ledges (156, 166) on the V-shaped end (150) of said die head (118), and camming means (218) fixed to said attachment plate means (112) and being engaged by the other end (216) of said lever means (214) for vertically depressing said punch means toward said ledges (156, 166) on the V-shaped end of said die head (118) after the pneumatically operated means (114) has moved the die head (118) horizontally into said socket means.

2. A machine as claimed in claim 1 wherein said punch means includes a V-shaped frame fixed to said slide block and wherein said lever means includes a lever pivotally mounted on said U-shaped frame, and wherein said camming means includes a camming surface on one end of said lever and a camming roller mounted on said plate means for engagement by said camming surface.

3. A machine as claimed in claim 2 wherein, said punch means includes a punch plate and a punching blade, said punch blade defining the lower edges which are depressed toward the end ledges on said die head.

4. A machine as claimed in claim 3 wherein, said supporting frame includes a table surface means and a plurality of legs for supporting the table surface means, and wherein the forming die mechanism is operatively disposed underneath said table surface means whereby the forming die mechanism is safely removed from a human operator.

* * * * *